United States Patent [19]

Jackson et al.

[11] 4,117,179

[45] Sep. 26, 1978

[54] OXIDATION CORROSION RESISTANT SUPERALLOYS AND COATINGS

[75] Inventors: Melvin R. Jackson; John R. Rairden, III, both of Schenectady, N.Y.

[73] Assignee: General Electric Company, Schenectady, N.Y.

[21] Appl. No.: 738,649

[22] Filed: Nov. 4, 1976

[51] Int. Cl.[2] ..... B32B 15/04; B32B 15/20

[52] U.S. Cl. ..... 427/405; 427/250; 427/252; 427/34; 427/423; 428/652; 428/653; 428/662; 428/663; 428/667

[58] Field of Search ..... 427/405, 34, 249, 250; 29/194, 195 C, 197; 75/170, 171; 428/652, 653, 662, 663, 667

[56] References Cited

U.S. PATENT DOCUMENTS

| | | | |
|---|---|---|---|
| 3,573,963 | 4/1971 | Maxwell | 427/405 X |
| 3,741,791 | 6/1973 | Maxwell et al. | 427/250 |
| 3,873,347 | 3/1975 | Walker et al. | 427/250 |
| 4,003,765 | 1/1977 | Davidson | 75/171 X |

FOREIGN PATENT DOCUMENTS

| | | | |
|---|---|---|---|
| 710,749 | 6/1965 | Canada | 427/405 |

*Primary Examiner*—Ralph S. Kendall

*Attorney, Agent, or Firm*—F. Wesley Turner; Joseph T. Cohen; Charles T. Watts

[57] ABSTRACT

An article of manufacture having improved high temperature oxidation and corrosion resistance comprising: (a) a superalloy substrate containing a carbide reinforcing phase, and (b) a coating consisting of chromium, aluminum, carbon, at least one element selected from iron, cobalt or nickel, and optionally an element selected from yttrium or the rare earth elements.

8 Claims, 3 Drawing Figures

OXIDATION CORROSION RESISTANT SUPERALLOYS AND COATINGS

Figure 1:
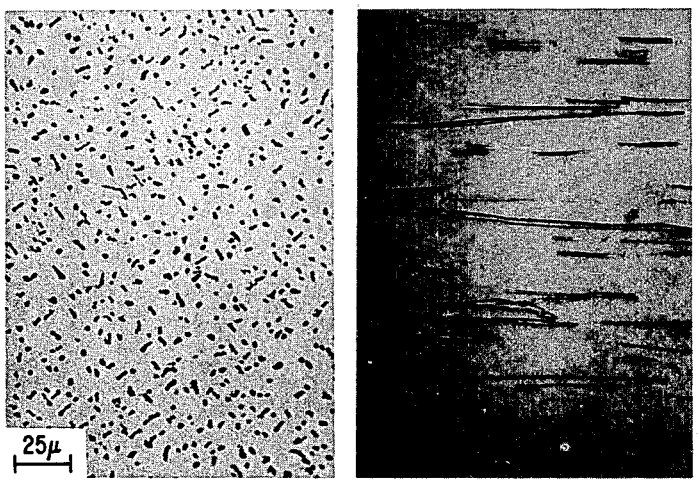

The invention described herein was made in the performance of work under a NASA contract and is subject to the provisions of Section 305 of the National Aeronautic and Space Act of 1958, Public Law 85-568 (72 Stat. 435 42 USC 2457).

BACKGROUND OF THE INVENTION

The present invention relates to an article of manufacture having improved high temperature oxidation and corrosion resistance comprising: (a) a superalloy substrate containing a carbide reinforcing phase, and (b) a coating consisting of chromium, aluminum, carbon, at least one element selected from iron, cobalt or nickel, and optionally an element selected from yttrium or the rare earth elements. Another embodiment of this invention comprises an aluminized overcoating of the coated superalloy. Still another embodiment of this invention comprises the method of making the article of manufacture described herein.

DESCRIPTION OF THE PRIOR ART

Carbide reinforced superalloys well-known to the art are employed widely in articles of manufacture employed in gas turbine engines including those which power aircraft engines. The superalloys which are carbide reinforced include conventionally cast, for example, nickel-base and cobalt-base superalloys, directionally solidified nickel-base and cobalt-base superalloys including eutectic alloys, as well as refractory alloys, etc. These alloys belong to a class of superstrength superalloys which rely on carbides for at least a portion of their overall strength.

To further enhance the ability of superalloys in gas turbine applications, surface coatings generally are used to protect superalloy articles from deleterious high temperature oxidation, corrosion and erosion effects. Especially useful coating compositions (especially with directionally solidified eutectic compositions which have an aligned carbide reinforcing fibrous phase) are coating compositions consisting essentially of chromium, aluminum, at least one element selected from iron, cobalt or nickel, and optionally an element selected from yttrium or rare earth elements. Aluminization of the coatings further enhances the oxidation and corrosion resistance of the coated superalloy.

Although the above-described prior art coated superalloys have improved oxidation and corrosion resistance at elevated temperatures, including service temperatures where it is highly desirable to maintain the integrity of the substrates at temperatures approaching 1100° C., the prior art coated superalloys exhibit deficiencies in the form of a carbide depletion at the interface of the coating and the substrate as a result of diffusion of carbon from the substrate into the oxidation and corrosion resistant coatings. This undesired diffusion of carbon from the solid state chemistry of the substrate into the oxidation and corrosion resistant coatings significantly and deleteriously affects the phases which strengthen the superalloys.

DESCRIPTION OF THE INVENTION

This invention embodies an article of manufacture having improved high temperature oxidation and corrosion resistance comprising: (a) superalloy substrate containing a carbide reinforcing phase, and (b) a coating consisting of chromium, aluminum, carbon, at least one element selected from iron, cobalt or iron, and optionally an element selected from yttrium or rare earth elements. Another embodiment of this invention comprises an aluminized overcoating of the coated superalloy. Still another embodiment comprises methods of preparing the aforesaid articles of manufacture.

Broadly, any of the superalloy compositions included within the Compilation of Chemical Compositions and Rupture Strengths of Superalloys described in the ASTM data series publication no. DS9E, which include carbon within the alloy and rely on carbides for at least a portion of their reinforcing strengths, e.g. (1) carbide reinforcement of grain boundaries in (a) monocarbide form, commonly referred to as MC, and (b) chromium carbide forms, commonly referred to as $M_{23}C_6$ and $M_7C_3$, (2) refractory metal carbides, etc., in platelet or fiber form strengthening grain interiors, aligned or non-aligned in accordance with the method of casting using conventional or directional solidification casting techniques, are included within the scope of our invention. Representative generally useful superalloys include nickel-base alloys, iron nickel-base alloys, cobalt-base alloys or refractory metal alloys of the compositions summarized in Table I which follows:

TABLE I

| | Nominal Composition, Weight %. | | | | | | | | | | | | | | |
|---|---|---|---|---|---|---|---|---|---|---|---|---|---|---|---|
| Alloy(s) | C | Mn | Si | Cr | Ni | Co | Mo | W | Cb | Ti | Al | B | Zr | Fe | Other |
| Nickel-Base Alloys | | | | | | | | | | | | | | | |
| IN-739 | 0.17 | 0.2 | 0.3 | 16 | Bal | 8.5 | 1.75 | 2.6 | .9 | 3.4 | 3.4 | .01 | 0.10 | 0.5 | 1.75Ta |
| MAR-M200(a) | 0.15 | — | — | 9.0 | Bal | 10 | — | 12.5 | 1.0 | 2.0 | 5.0 | 0.015 | 0.05 | — | — |
| NX-188(a)(b) | 0.04 | — | — | — | Bal | — | 18 | — | — | — | 8 | — | — | — | — |
| Rene 80 | 0.17 | — | — | 14 | Bal | 9.5 | 4.0 | 4.0 | — | 5.0 | 3.0 | 0.015 | 0.03 | — | — |
| Rene 95 | 0.15 | — | — | 14 | Bal | 8.0 | 3.5 | 3.5 | 3.5 | 2.5 | 3.5 | 0.05 | — | — | |
| | | | | | | | | | | | 0.01 | | | | |
| TAZ-8B(a)(b) | 0.125 | — | — | 6.0 | Bal | 5.0 | 4.0 | 4.0 | 1.5 | — | 6.0 | 0.004 | 1.0 | — | 8.0Ta |
| TRW VI A(a) | 0.13 | — | — | 6 | Bal | 7.5 | 2.0 | 5.8 | 0.5 | 1.0 | 5.4 | 0.02 | 0.13 | — | 9.0Ta,0.5Re, 0.43Hf |
| WAZ-20(a)(b) | 0.15 | — | — | — | Bal | — | — | 18.5 | — | — | 6.2 | — | 1.5 | — | — |
| Iron-Nickel-Base Alloys | | | | | | | | | | | | | | | |
| Incoloy 802 | 0.35 | 0.75 | 0.38 | 21 | 32.5 | — | — | — | — | — | — | — | — | Bal | — |
| S-590 | 0.43 | 1.25 | 0.40 | 20.5 | 20 | 20 | 4.0 | 4.0 | 4.0 | — | — | — | — | Bal | — |
| Duraloy "HOM-3"(b) | 0.50 | 0.80 | 1.0 | 25.5 | 45.5 | 3.25 | 3.25 | 3.25 | — | — | — | — | — | Bal | — |
| Cobalt-Base Alloys | | | | | | | | | | | | | | | |
| FSX-414(a) | 0.25 | 1.0(c) | 1.0(c) | 29.5 | 10.5 | Bal | — | 7.0 | — | — | — | 0.012 | — | 2.0(c) | — |
| FSX-430(a) | 0.40 | — | — | 29.5 | 10.0 | Bal | — | 7.5 | — | — | — | 0.027 | 0.9 | — | 0.5Y |
| MAR-M509(a) | 0.60 | 0.10(c) | 0.10(c) | 21.5 | 10 | Bal | — | 7.0 | — | 0.2 | — | 0.010(c) | 0.50 | 1.0 | 3,5Ta |
| X-45(a) | 0.25 | 1.0(c) | — | 25.5 | 10.5 | Bal | — | 7.0 | — | — | — | 0.010 | — | 2.0(c) | — |

TABLE I-continued

| Alloy(s) | Nominal Composition, Weight % | | | | | | | | | | | | | | |
|---|---|---|---|---|---|---|---|---|---|---|---|---|---|---|---|
| | C | Mn | Si | Cr | Ni | Co | Mo | W | Cb | Ti | Al | B | Zr | Fe | Other |
| Refractory Metal Alloys | | | | | | | | | | | | | | | |
| WC3015 | 0.3 | — | — | — | — | — | — | 15 | Bal | — | — | — | 1 | a — | 30Hf |
| Cb132M | 0.1 | — | — | — | — | — | 5 | 15 | Bal | — | — | — | 1.5 | — | 20Ta |
| SU31 | 0.12 | — | 0.03 | — | — | — | — | 17 | Bal | — | — | — | — | — | 3.5Hf |
| TZC | 0.15 | — | — | — | — | — | Bal | — | — | 1.25 | — | — | 0.3 | — | — |

(a) Cast alloy
(b) Directionally solidified
(c) Maximum composition

The coating compositions consist essentially of chromium, aluminum, carbon, at least one element selected from iron, cobalt or nickel, and optionally an element selected from yttrium or the rare earth elements. The coating compositions can be described by the formulas:

MCaAlC or MCrAlCY, in which M is base metal element, e.g. iron, cobalt or nickel. Any amount of base metal element, chromium, aluminum, and optionally yttrium or a rare earth element can be employed in accordance with the amounts well-known to those skilled in the art with regard to oxidation and corrosion resistant coatings containing the aforesaid elements subject to the proviso that the coatings contain an amount of carbon (1) sufficient to saturate the solid state phases of the coating composition, (2) sufficient to essentially equilibrate the chemical potential of carbon in the coating with that in the substrate with minimum interaction, and (3) insufficient to form substantial quantities of carbides in the coating composition. The function of the carbon in the coating is to avoid denudation of the carbide reinforcement in the substrate which has been found to occur very rapidly at service temperatures equal to or greater than 1100° C., during periods of time in the order of magnitude of 1-3 hours. Denudation will occur at lower temperatures over longer time exposures. Those skilled in the art by means of routine experimentation will be able to determine the amount of carbon required in the coating composition in order to avoid any change in the superalloy substrate chemical structure due to diffusion of carbon contained within the substrate into a carbon free MCrAL or MCrAlY coating. The discovery that the addition of nominal amounts of carbon to prior art coatings generally known in the art as MCrAlY coatings as an effective means of providing carbide stabilized oxidation and corrosion resistant coating compositions for carbide reinforced superalloy substrates is unexpected since at service temperatures of about 1100° C. — prior to testing of the coating of this invention — we believed that carbon would likely diffuuse not only from the substrate into the coating but also through the coating into the coating atmosphere with subsequent continuous oxidation of carbon at the coating atmosphere interface.

In general, presently preferred carbon stabilized MCrAlY coatings are of the compositions in weight percentages set out in the following table:

TABLE II

| Ingredients | General | Preferred | More Preferred | Most Preferred |
|---|---|---|---|---|
| chromium | 10-50 | 10-30 | 15-25 | 19-21 |
| aluminum | 0-20 | 2-15 | 4-11 | 4-11 |
| carbon | 0.01-0.5 | 0.01-0.2 | 0.05-0.15 | 0.05-0.15 |
| yttrium | 0-1.5 | 0-1.5 | 0-1.5 | 0.05-0.25 |

TABLE II-continued

| Ingredients | General | Preferred | More Preferred | Most Preferred |
|---|---|---|---|---|
| iron, cobalt, nickel | Bal | Bal | Bal | Bal |

The preferred aluminum content depends strongly on whether a duplex aluminizing treatment is to be given to the coated superalloy substrate. The carbon-saturated MCrAlY coating of our invention can be applied to the superalloy substrates by any means whereby carbon contained within the MCrAlY coating is uniformly distributed throughout the coating or localized in the coating adjacent to the superalloy interface surface, subject to the proviso that the carbon content of the coating be sufficient to completely saturate all of the MCrAlY phases with carbon, however, insufficient to form excessive amounts of carbides within the coating composition which deleteriously affect the oxidation and corrosion resistance of the coating under superalloy service conditions.

In general, the carbon saturated MCrAlY coatings can be applied by any means such as (1) Physical Vapor Deposition (subject to the proviso that the carbon be deposited from a separate carbon source since carbon, which has a very low vapor pressure, if contained in the MCrAlY melt source would not be transferred to the superalloy substrate), (2) Chemical Vapor Deposition wherein organometallic compounds are employed wherein during decomposition of the organometallic compounds the carbon residue incorporated into the coating is present in amounts sufficient to saturate all phases of the coating, and (3) Carburization wherein the MCrAlY coating is saturated with carbon by pack carburizing or gas carburizing the PVD coating in an atmosphere containing carbon such as an atmosphere of carbon monoxide or carbon dioxide, etc. A preferred method of preparing the coated superalloy substrates of our invention employs a flame spraying procedure wherein an alloy wire or powder of a carbon saturated MCrAlY composition is deposited on a superalloy surface. Flame spraying or arc plasma spray deposition involves projecting liquid droplets onto a superalloy substrate by means of a high velocity gas stream. To minimize the oxygen content of the coating, deposition is often done in an inert atmosphere such as argon or vacuum. In general, methods which can be employed are well known to those skilled in the art and are described in the following publications:

Flame Spray Handbook, Volume III, by H. S. Ingham and A. P. Shepard, published by Metco, Inc., Westbury, Long Island, N.Y. (1965), and Vapor Deposition, edited by C. F. Powell, J. H. Oxley and J. M. Blocher, Jr., puslished by John Wiley & Sons, Inc., New York (1966).

As mentioned hereinbefore, the carbon saturated MCrAlY coated article of this invention can be further improved in oxidation and corrosion resistance by aluminizing the MCrAlY coated substrate by any method known to those skilled in the art, including Physical Vapor Deposition procedures described in detail in Vapor Deposition, edited by C. F. Powell et al., John Wiley & Sons, New York (1966).

Our invention is more clearly understood from the following description taken in conjunction with the accompanying figures described hereafter.

FIG. 1 is a photomicrograph of a transverse section (a) and a longitudinal section (b) of a photomicrograph of a directionally solidified nickel-base superalloy eutectic having a melt composition on a weight percent basis of Ni-3.3Co-4.4Cr-3.1W-5.4Al-5.6V-6.2Re-8.1Ta-0.54C. The photomicrograph section magnified (400X) shows an aligned monocarbide microstructure fiber formed during solidification comprising tantalum and vanadium carbides (Ta,V)C which can be identified as the darkest phase shown in the photomicrographs of both the transverse and longitudinal sections. The carbide fibers are approximately 1 μm in cross section and comprise 2–4 volume percent of the microstructure. A face-centered-cubic ordered structure based on $Ni_3Al$, $\gamma'$, is present in the structure but cannot be seen in the unetched sample shown in FIG. 1. For purposes of brevity hereafter, the alloy melt composition described is hereafter referred to as NiTaC-13.

Figure 2:
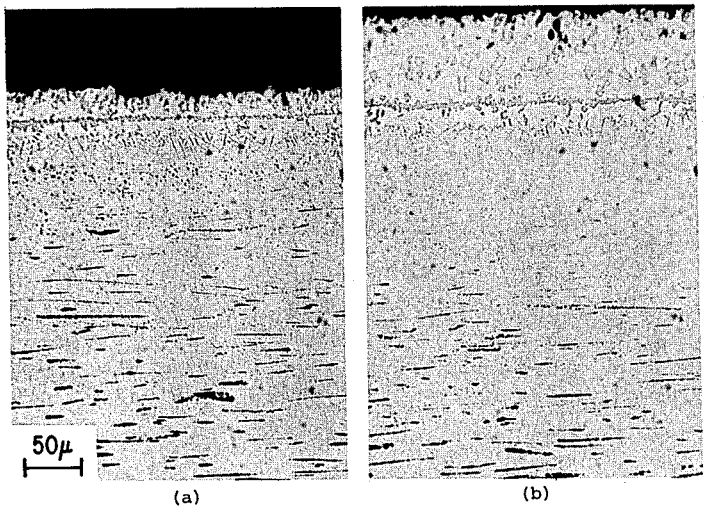

FIG. 2 is a photomicrograph (200X) of a NiTaC-13 alloy which had been coated, on a weight percent basis, with a carbon free nickel-20 chromium-10 aluminum-1.0 yttrium composition having an initial coating about 75 μm in thickness. FIG. 2(*a*) is the NiTaC-13 coated composition machined to remove approximately one-half of the coating over a section 0.3 centimeters long of the FIG. 2(*b*) 75 μm coating, thereby reducing it to a thickness of about 25 μm. The photomicrographs illustrate that after 119 hours of cyclic oxidation exposure at 1100° C. the coated regions having about a 75 μm thickness exhibit approximately twice the carbide fiber denudation as the composition having a coating thickness of about 25 μm. This figure illustrates that the coating acts as a sink for carbon since the 75 μm thick coating shows approximately twice the fiber denudation as the 25 μm thick coating.

Figure 3:
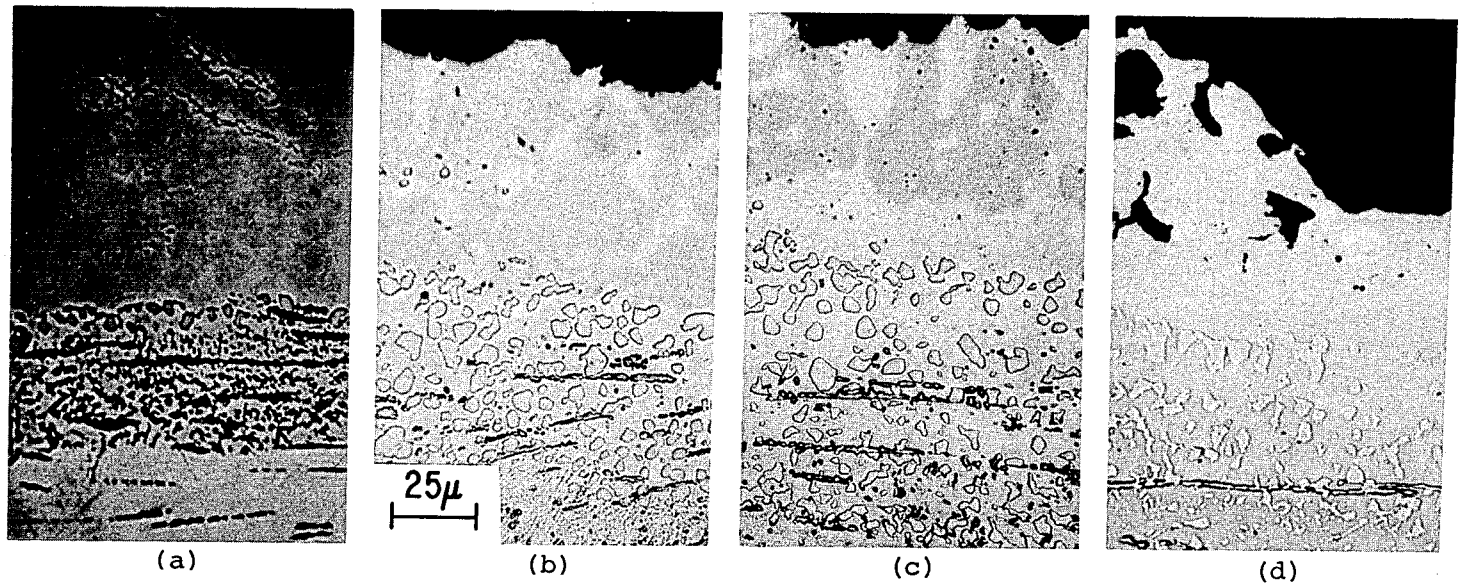

FIG. 3 is a photomicrograph (600X) of a longitudinal section of the alloy of FIGS. 1 and 2 which has been coated with a carbon saturated composition having a coating composition, on a weight percent basis, of nickel-20 chromium-5 aluminum-0.1 carbon-0.1 yttrium, and subsequently aluminized. FIG. 3(*a*) is a longitudinal cross-section of the as-deposited coating. FIGS. 3(*b*), (*c*) and (*d*) are longitudinal sections of cyclically oxidized coatings after 1000 hrs., 1500 hrs. and 2000 hrs., respectively. Cyclic oxidation consisted of one hour cycles wherein the coated alloy test specimens were exposed 50 minutes at 1100° C. in a static air furnace and 10 minutes at 93° C. in a forced-air cooler. The cross sections of the carbon containing aluminized coatings and substrate illustrate that there is no carbon denudation as a result of introducing a sufficient amount of carbon to the MCrAlY coating to provide carbon in an amount sufficient to saturate the phases of the MCrAlY coating.

Our invention is further illustrated by the following example:

EXAMPLE I

Pins of NiTaC-13 were electro-discharged machined from directionally solidified NiTaC-13 ingots which had been melted with a radio frequency graphite susceptor system and solidified at 0.635 centimeters per hour. Prior to deposition of the coating the pin specimens were centerless ground and lightly abraded with alumina powder. The NiTaC-13 pin samples were 4.4 centimeters long and 0.25 centimeters in diameter. The TaC fiber direction was along the axis of the pin specimens.

Ingots of carbon-containing and noncarbon-containing MCrAlY coating source alloys were prepared by induction melting high-purity metals in a low-pressure, nonoxidizing environment with subsequent casting of the alloys in an argon atmosphere. The alloys containing carbon were hot swaged to 0.33 centimeters diameter wire for flame spraying purposes. For electron beam deposition of carbon-free coatings, two 0.25 cm. diameter pin specimens were mounted approximately 10 centimeters from the deposition source and were rotated at approximately 10 rpm during deposition of coatings. Specimens coated using flame-spraying techniques were mounted approximately 15 centimeters from the carbon bearing wire spray source and were rotated at approximately 200 rpm during deposition.

The coating composition for the electron beam coating employed a nickel-20 chromium-10 aluminum-1 yttrium source which deposited a composition of nickel-20 chromium-10 aluminum approximately 0.1 yttrium coating on the superalloy substrate. The flame spraying source alloy contained nickel-20 chromium-5 aluminum-0.1 yttrium-0.1 carbon and was used for MCrAlCY coating of the superalloy substrate. The MCrAlCY coated pins were subsequently aluminized by duplex coating techniques employing pack-aluminization in a 1% aluminum pack at 1060° C. for 3 hours in dry argon. Sufficient aluminum-aluminum oxide ($Al_2O_3$) mixed powder was used to produce approximately 6 milligrams per square centimeter of aluminum deposition during the pack cementation process.

Following cyclic oxidation as described hereinbefore, the test specimens were evaluated by metallographic techniques. The results are recorded in FIGS. 2 and 3 described hereinbefore. As illustrated by this specific example as well as the photomicrographs, carbon saturation of oxidation and corrosion resistant coatings, commonly referred to as MCrAlY coatings, effectively substantially eliminates carbon depletion or denudation of carbide reinforced superalloy substrates. This carbide stabilization effect significantly enhances the retention of phases in the superalloy responsible for the physical strength properties which are essential to gas turbine engine articles of manufacture having service temperatures in the range of 1100° to 1160° C. or even higher. In view of the significance of retaining the alloy chemistry during the expected life of the alloy substrates, especially with regard to superalloys which are employed as thin-section superalloy components in jet engine designs, it is anticipated that the inclusion of carbon in amounts sufficient to saturate all phases of the coating may increase the service life of the superalloy substrate by as much as 100 percent over the service life which would be obtained in the absence of carbon in the coating compositions.

Although the above examples have illustrated various modifications and changes that can be made in carrying out our process, it will be apparent to those skilled in the art that other changes and modifications can be made in the particular embodiments of the invention described which are within the full intended scope of the invention as defined by the appended claims.

We claim:

1. A method of improving the high temperature oxidation and corrosion resistance and preventing loss of strength of a carbide containing superalloy body, said body containing a carbide reinforcing phase, comprising steps of: (a) coating the superalloy body with a composition consisting essentially of chromium, aluminum, carbon and at least one element selected from iron, cobalt, or nickel, subject to the proviso that the coatings contain an amount of carbon (1) sufficient to saturate any solid state phases of the coating composition, (2) sufficient to essentially equilibrate the chemical potential of carbon in the coating with that in the substrate with minimum interaction, and (3) insufficient to form substantial quantities of carbides in the coating composition.

2. The claim 1 method, wherein the coating contains an element selected from ytrrium or the rare earth elements.

3. The claim 2 method, further comprising: (b) subjecting the coated body to an aluminizing overcoating to further increase the oxidation and corrosion resistance of the coating.

4. The claim 1 method, wherein the superalloy body is selected from a wrought, conventionally cast, directionally solidified or powder formed nickel or a cobalt-base superalloy body.

5. The claim 1 method, wherein the superalloy is a directionally solidified multivariant eutectic comprising a matrix of nickel or cobalt-base superalloy body, the matrix being an aligned eutectic carbide reinforcing phase.

6. The claim 5 method, wherein the eutectic carbide reinforcing phase is selected from carbides of the group consisting of tantalum and vanadium and their alloys and mixture thereof embedded in the matrix.

7. The claim 1 method wherein the superalloy body and the coating have initially essentially the same carbon chemical potential.

8. A method of improving the high temperature oxidation and corrosion resistance and preventing loss of strength of a carbide containing superalloy body, said body containing a carbide reinforcing phase, comprising steps of: (a) coating the superalloy body with a composition consisting essentially of chromium, aluminum, carbon and at least one element selected from iron, cobalt, or nickel, subject to the proviso that the coatings contain an amount of carbon (1) sufficient to saturate any solid state phases of the coating composition, (2) sufficient to essentially equilibrate the chemical potential of carbon in the coating with that in the substrate with minimum interaction, and (3) insufficient to form substantial quantities of carbides in the coating composition, and (3) insufficient to form substantial quantities of carbides in the coating compositions; and (b) subjecting the coated body to an aluminizing overcoating to further increase the oxidation and corrosion resistance of the coating.

* * * * *